US007011027B2

(12) United States Patent
Reese et al.

(10) Patent No.: US 7,011,027 B2
(45) Date of Patent: Mar. 14, 2006

(54) COATED METAL PARTICLES TO ENHANCE OIL FIELD SHAPED CHARGE PERFORMANCE

(75) Inventors: James Warren Reese, Spring, TX (US); Avigdor Hetz, Houston, TX (US)

(73) Assignee: Baker Hughes, Incorporated, Houston, TX (US)

( * ) Notice: Subject to any disclaimer, the term of this patent is extended or adjusted under 35 U.S.C. 154(b) by 0 days.

(21) Appl. No.: 09/860,118

(22) Filed: May 17, 2001

(65) Prior Publication Data

US 2002/0178962 A1 Dec. 5, 2002

Related U.S. Application Data

(60) Provisional application No. 60/206,100, filed on May 20, 2000.

(51) Int. Cl.
*F42B 1/02* (2006.01)
*F42B 1/032* (2006.01)

(52) U.S. Cl. ..... 102/307; 102/476; 102/306

(58) Field of Classification Search ..... 102/307, 102/476, 306, 308–310
See application file for complete search history.

(56) References Cited

U.S. PATENT DOCUMENTS

| | | | | |
|---|---|---|---|---|
| 3,077,834 A | | 2/1963 | Caldwell | |
| 3,375,108 A | | 3/1968 | Wyman, Sr. et al. | |
| 3,388,663 A | | 6/1968 | Wyman, Sr. et al. | |
| 4,498,367 A | | 2/1985 | Skolnick et al. | |
| 4,498,395 A | * | 2/1985 | Kock et al. | 102/517 |
| 4,592,790 A | * | 6/1986 | Globus | 148/126.1 |
| 4,613,370 A | | 9/1986 | Held et al. | |
| 4,766,813 A | | 8/1988 | Winter et al. | |
| 4,794,990 A | * | 1/1989 | Riggs | 166/299 |
| 5,119,729 A | | 6/1992 | Nguyen | |
| 5,221,808 A | | 6/1993 | Werner et al. | |
| 5,279,228 A | | 1/1994 | Ayer | |
| 5,413,048 A | | 5/1995 | Werner et al. | |
| 5,567,906 A | | 10/1996 | Reese et al. | |
| 5,656,791 A | | 8/1997 | Reese et al. | |
| 5,814,758 A | | 9/1998 | Leidel | |
| 5,963,776 A | * | 10/1999 | Lowden et al. | 102/517 |
| 6,012,392 A | * | 1/2000 | Norman et al. | 102/307 |

FOREIGN PATENT DOCUMENTS

| | | | | |
|---|---|---|---|---|
| DE | 3729780 | * | 5/1993 | 102/306 |

OTHER PUBLICATIONS

US 6,470,804, 10/2002, Leidel et al. (withdrawn)*

* cited by examiner

*Primary Examiner*—Michael J. Carone
*Assistant Examiner*—James S. Bergin
(74) *Attorney, Agent, or Firm*—Timothy Donoughue; Keith R. Derrington

(57) ABSTRACT

A liner for a shaped charge comprising powdered heavy metal tungsten coated with a metal binder coating compressively formed into a liner body. Each of the powdered heavy metal particles are substantially uniformly coated with metal binder coating. The preferred powdered heavy metal particles are comprised of tungsten. Optionally, the liner for a shaped charge includes a lubricant intermixed with the coated heavy metal particles. The metal binder coating is selected from the group consisting of copper, lead, nickel, tantalum, other malleable metals, and alloys thereof, and comprises from 40 percent to 3 percent by weight of the liner. The powdered heavy metal particles comprise from 60 percent to 97 percent by weight of the liner.

9 Claims, 2 Drawing Sheets

FIG. 3
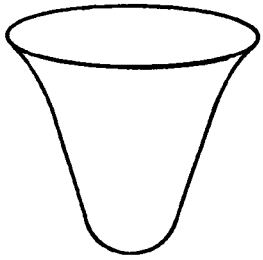
FIG. 4
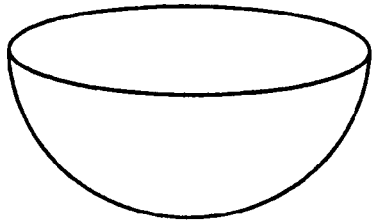
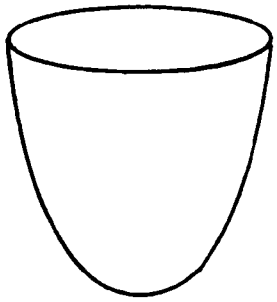
FIG. 5
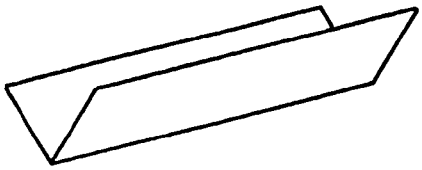
FIG. 6
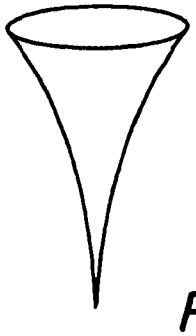
FIG. 7

COATED METAL PARTICLES TO ENHANCE OIL FIELD SHAPED CHARGE PERFORMANCE

RELATED APPLICATIONS

This application claims priority from now abandoned U.S. Provisional Application No. 60/206,100, filed May 20, 2000, the full disclosure of which is hereby incorporated by reference herein.

BACKGROUND OF THE INVENTION

1. Field of the Invention

The invention relates generally to the field of explosive shaped charges. More specifically, the present invention relates to a composition of matter for use as a liner in a shaped charge, particularly a shaped charge used for oil well perforating.

2. Description of Related Art

Shaped charges are used for the purpose, among others, of making hydraulic communication passages, called perforations, in wellbores drilled through earth formations so that predetermined zones of the earth formations can be hydraulically connected to the wellbore. Perforations are needed because wellbores are typically completed by coaxially inserting a pipe or casing into the wellbore, and the casing is retained in the wellbore by pumping cement into the annular space between the wellbore and the casing. The cemented casing is provided in the wellbore for the specific purpose of hydraulically isolating from each other the various earth formations penetrated by the wellbore.

Shaped charges known in the art for perforating wellbores are used in conjunction with a perforation gun and the shaped charges typically include a housing, a liner, and a quantity of high explosive inserted between the liner and the housing where the high explosive is usually HMX, RDX PYX, or HNS. When the high explosive is detonated, the force of the detonation collapses the liner and ejects it from one end of the charge at very high velocity in a pattern called a "jet". The jet penetrates the casing, the cement and a quantity of the formation. The quantity of the formation which may be penetrated by the jet can be estimated for a particular design shaped charge by test detonation of a similar shaped charge under standardized conditions. The test includes using a long cement "target" through which the jet partially penetrates. The depth of jet penetration through the specification target for any particular type of shaped charge relates to the depth of jet penetration of the particular perforation gun system through an earth formation.

In order to provide perforations which have efficient hydraulic communication with the formation, it is known in the art to design shaped charges in various ways to provide a jet which can penetrate a large quantity of formation, the quantity usually referred to as the "penetration depth" of the perforation. One method known in the art for increasing the penetration depth is to increase the quantity of explosive provided within the housing. A drawback to increasing the quantity of explosive is that some of the energy of the detonation is expended in directions other than the direction in which the jet is expelled from the housing. As the quantity of explosive is increased, therefore, it is possible to increase the amount of detonation-caused damage to the wellbore and to equipment used to transport the shaped charge to the depth within the wellbore at which the perforation is to be made.

The sound speed of a shaped charge liner is the theoretical maximum speed that the liner can travel and still form a coherent "jet". If the liner is collapsed at a speed (collapse speed) that exceeds the sound speed of the liner material the resulting jet will not be coherent. A coherent jet is a jet that consists of a continuous stream of small particles. A non-coherent jet contains large particles or is a jet comprised of multiple streams of particles. The sound speed of a liner material is calculated by the following equation, sound speed=(bulk modulus/density)$^{1/2}$ (Equation 1.1). Increasing the collapse speed of a liner will in turn increase the jet tip speed. Increased jet tip speeds are desired since an increase in jet tip speed increases the kinetic energy of the jet which provides increased well bore penetration. Therefore, liner materials having higher sound speeds are preferred because this provides for increased collapse speeds while maintaining jet coherency.

Accordingly, it is important to supply a detonation charge to the shaped charge liner that does not cause the shaped charge liner to exceed its sound speed. On the other hand, to maximize penetration depth, it is desired to operate shaped charge liners at close to their sound speed and to utilize shaped charge liners having maximum sound speeds. Furthermore, it is important to produce a jet stream that is coherent because the penetration depth of coherent jet streams is greater than the penetration depth of non-coherent jet streams. Both of these goals can be attained by utilizing shaped liner materials that have high sound speeds.

As per Equation 1.1 adjusting the physical properties of the shaped charge liner materials can affect the sound speed of the resulting jet. Furthermore, the physical properties of the shaped charge liner material can be adjusted to increase the sound speed of the shaped charge liner, which in turn increases the maximum allowable speed to form a coherent jet. As noted previously, knowing the sound speed of a shaped charge liner is important since a non-coherent jet will be formed if the collapse speed of the liner well exceeds the sound speed.

It is also known in the art to design the shape of the liner in various ways so as to maximize the penetration depth of the shaped charge for any particular quantity of explosive. Even if the liner geometry and sound speed of the shaped charge liner is optimized, the amount of energy which can be transferred to the liner for making the perforation is necessarily limited by the quantity of explosive.

Shaped charge performance is dependent on other properties of the liner material. Density and ductility are properties that affect the shaped charge performance. Optimal performance of a shaped charge liner occurs when the jet formed by the shaped charge liner is long, coherent and highly dense. The density of the jet can be controlled by utilizing a high density liner material. Jet length is determined by jet tip velocity and the jet velocity gradient. The jet velocity gradient is the rate at which the velocity of the jet changes along the length of the jet whereas the jet tip velocity is the velocity of the jet tip. The jet tip velocity and jet velocity gradient are controlled by liner material and geometry. The higher the jet tip velocity and the jet velocity gradient the longer the jet.

In solid liners, a ductile material is desired since the solid liner can stretch into a longer jet before the velocity gradient causes the liner to begin fragmenting. In porous liners, it is desirable to have the liner form a long, dense, continuous stream of small particles. To produce a coherent jet, either from a solid liner or a porous liner; the liner material must be such that the liner does not splinter into large fragments after detonation.

The solid shaped charge liners are formed by cold working a metal into the desired shape, others are formed by adding a coating onto the cold formed liner to produce a composite liner. Information relevant to cold worked liners is addressed in Winter et al., U.S. Pat. No. 4,766,813, Ayer U.S. Pat. No. 5,279,228, and Skolnick et al., U.S. Pat. No. 4,498,367. However, solid liners suffer from the disadvantage of allowing "carrots" to form and become lodged in the resulting perforation—which reduces the hydrocarbon flow from the producing zone into the wellbore. Carrots are sections of the shaped charge liner that form into solid slugs after the liner has been detonated and do not become part of the shaped charge jet. Instead, the carrots can take on an oval shape, travel at a velocity that is lower than the shaped charge jet velocity and thus trail the shaped charge jet.

Porous liners are formed by compressing powdered metal into a substantially conically shaped rigid body. Typically, the liners that have been formed by compressing powdered metals have utilized a composite of two or more different metals, where at least one of the powdered metals is a heavy or higher density metal, and at least one of the powdered metals acts as a binder or matrix to bind the heavy or higher density metal. Examples of heavy or higher density metals used in the past to form liners for shaped charges have included tungsten, hafnium, copper, or bismuth. Typically the binders or matrix metals used comprise powdered lead, however powdered bismuth has been used as a binder or matrix metal. While lead and bismuth are more typically used as the binder or matrix material for the powdered metal binder, other metals having high ductility and malleability can be used for the binder or matrix metal. Other metals which have high ductility and malleability and are suitable for use as a binder or matrix metal comprise zinc, tin, uranium, silver, gold, antimony, cobalt, copper, zinc alloys, tin alloys, nickel, and palladium. Information relevant to shaped charge liners formed with powdered metals is addressed in Werner et al., U.S. Pat. No. 5,221,808, Werner et al., U.S. Pat. No. 5,413,048, Leidel, U.S. Pat. No. 5,814,758, Held et al. U.S. Pat. No. 4,613,370, Reese et al., U.S. Pat. No. 5,656,791, and Reese et al., U.S. Pat. No. 5,567,906.

Each one of the aforementioned references relating to powdered metal liners suffer from the disadvantages of a limited shelf life, nonuniform density, and inconsistent performance results. To save labor cost and time it is desired to produce numerous shaped charge liners and then store them for future use. Shaped charge liners produced by traditional methods are subject to creep. Liner creep involves the shaped charge liner slightly expanding after being assembled and stored. Slight expansion of the shaped charge liner reduces shaped charge effectiveness and repeatability. Therefore, most shaped charge liners produced by the above mentioned traditional methods are fully assembled into a shaped charge to reduce or avoid liner creep.

Most of the porous shaped charge liners currently are fabricated by pressing a powdered metal mixture with a ram and die configuration. It is known and appreciated in the art that either the ram or the die can be rotated during the pressing process. Rotation of the die or ram during fabrication promotes powdered mixing and flow. During the fabrication process the liner materials can segregate thereby reducing the homogeneity of the final product. A liner that is not homogeneous does not have a uniform density. As such, each shaped charge liner produced often has different physical properties than the next or previously manufactured shaped charge liner. Therefore, the performance of the shaped charge liners cannot be accurately predicted which makes operational results that are difficult to reproduce. A liner that has a non-uniform density will not form as coherent a jet as a liner having a uniform density.

The sound speed of the shaped charge liner constituents affect the sound speed of the shaped charge liner. Therefore, increasing the sound speed of the binder or matrix material will in turn increase the sound speed of the shaped charge liner. Since shaped charge liners having increased sound speeds also exhibit increased performance, advantages can be realized by implementing binder or matrix materials having increased sound speeds.

Therefore, it is desired to produce a shaped charge liner that is not subject to creep, has a uniform density distribution, and has a predictable performance.

BRIEF SUMMARY OF THE INVENTION

A liner for a shaped charge comprising powdered heavy metal particles with a substantially uniform coating of metal binder coating, the coated heavy metal particles compressively formed into a liner body. The heavy metal particles are selected from the group consisting of tungsten, uranium, tantalum, and molybdenum. However, the preferred heavy metal particles are comprised of tungsten. Optionally, the liner for a shaped charge includes a lubricant intermixed with the coated heavy metal particles to aid in the forming process. The metal binder coating material is selected from the group consisting of copper, lead, nickel, other malleable metals, and alloys thereof. The metal binder coating material comprises from 40 percent to 3 percent by weight of the liner. The powdered heavy metal particles comprise from 60 percent to 97 percent by weight of the liner.

Also disclosed is a shaped charge comprising a housing, a quantity of explosive inserted into the housing, and a liner inserted into the housing. The quantity of explosive is positioned between the liner and the housing. The liner comprises powdered heavy metal particles that are coated with a metal binder coating. The liner is compressively formed into a liner body. Prior to being compressively formed into a liner body the powdered heavy metal particles are coated with the metal binder coating.

Other and further features and advantages will be apparent from the following description of presently preferred embodiments of the invention given for the purpose of disclosure.

BRIEF DESCRIPTION OF THE SEVERAL VIEWS OF THE DRAWING

FIG. 3 illustrates a perspective view a of tulip shaped liner.

FIG. 4 depicts a perspective view of a hemispherical liner.

FIG. 5 depicts a perspective view of a circumferential liner.

FIG. 6 illustrates a perspective view of a linear liner.

FIG. 7 illustrates a perspective view of a trumpet liner.

DETAILED DESCRIPTION OF THE INVENTION

Figure 1:
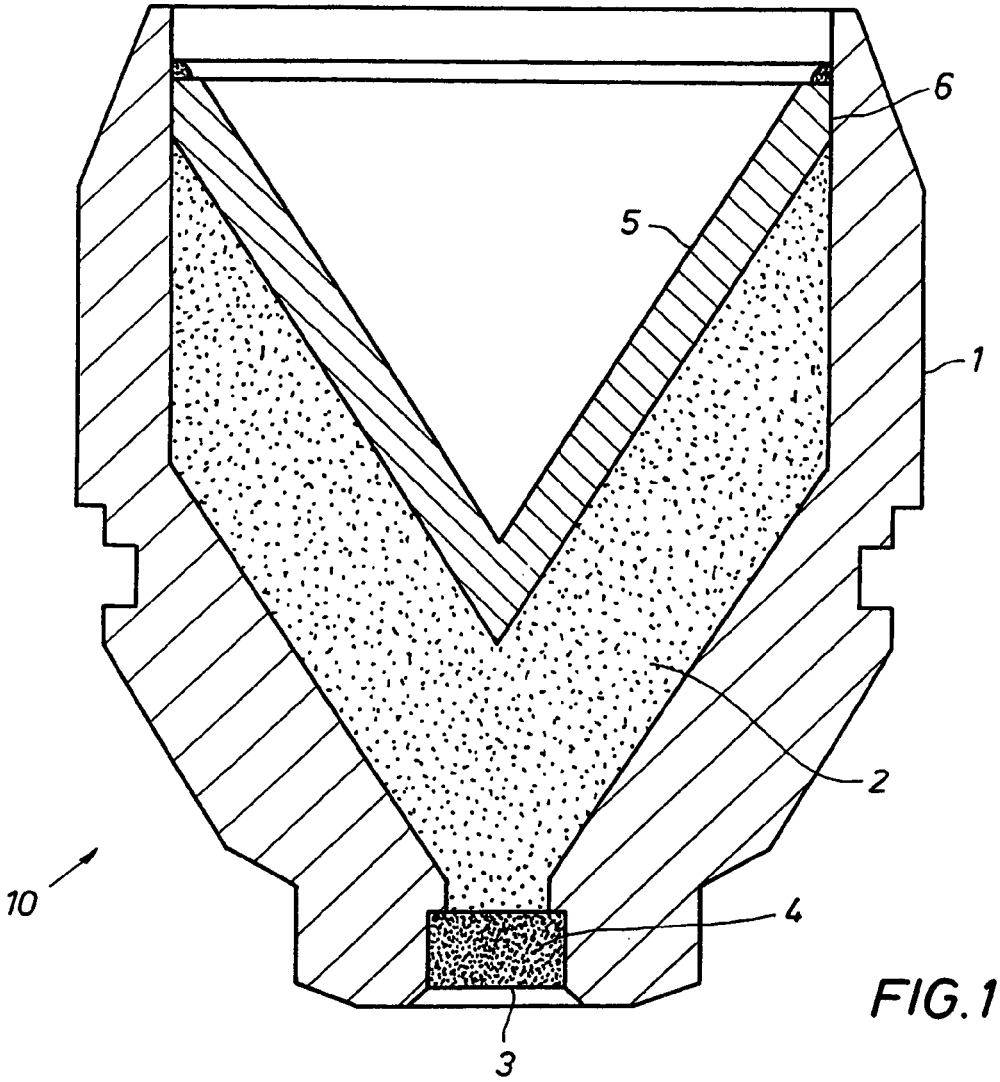
FIG. 1 depicts a cross-sectional view of a shaped charge with a liner according to the present invention.

With reference to the drawings herein, a shaped charge 10 according to the invention is shown in FIG. 1. The shaped charge 10 typically includes a generally cylindrically shaped housing 1, which can be formed from steel, ceramic or other material known in the art. A quantity of high explosive powder, shown generally at 2, is inserted into the interior of the housing 1. The high explosive 2 can be of a composition known in the art. High explosives known in the art for use in shaped charges include compositions sold under trade designations HMX, HNS, RDX, PYX and TNAZ. A recess 4 formed at the bottom of the housing 1 can contain a booster explosive (not shown) such as pure RDX. The booster explosive, as is understood by those skilled in the art, provides efficient transfer to the high explosive 2 of a detonating signal provided by a detonating cord (not shown) which is typically placed in contact with the exterior of the recess 4. The recess 4 can be externally covered with a seal, shown generally at 3.

A liner, shown at 5, is typically inserted on to the high explosive 2 far enough into the housing 1 so that the high explosive 2 substantially fills the volume between the housing 1 and the liner 5. The liner 5 in the present invention is typically made from powdered metal which is pressed under very high pressure into a generally conically shaped rigid body. The conical body is typically open at the base and is hollow. Compressing the powdered metal under sufficient pressure can cause the powder to behave substantially as a solid mass. The process of compressively forming the liner from powdered metal is understood by those skilled in the art.

As will be appreciated by those skilled in the art, the liner 5 of the present invention is not limited to conical or frusto-conical shapes, but can be formed into numerous shapes. Additional liner shapes can include bi-conical, tulip, hemispherical, circumferential, linear, and trumpet.

As is understood by those skilled in the art, when the explosive 2 is detonated, either directly by signal transfer from the detonating cord (not shown) or transfer through the booster explosive (not shown), the force of the detonation collapses the liner 5 and causes the liner 5 to be formed into a jet, once formed the jet is ejected from the housing 1 at very high velocity.

A novel aspect of the present invention is the configuration of the powdered heavy metal particles from which the liner 5 can be formed. The configuration of the powdered heavy metal particles of the present invention involves coating the powdered heavy metal particles with a metal binder coating prior to shaping the coated heavy metal particles into a liner. Various coating methods known in the art may be employed to coat the powdered heavy metal particles prior to compressively forming the shaped charge liner. One preferred method involves utilizing a hydrogen furnace to coat the binder material onto the powdered heavy metal particles. One skilled in the art can implement a hydrogen furnace such that essentially each individual powdered heavy metal particle is coated with the binder material. After the coating step is complete, the now coated heavy metal particles are placed into a ram/die configuration (not shown) and compressively shaped into the shaped charge liner 5.

Coating the powdered heavy metal particles prior to shaping the liner 5 prevents the dissimilar metal particles from segregating and thereby ensures that the liner 5 is substantially uniform and homogenous in composition. Better homogeneity cannot be achieved by simply increasing the time of ram/die rotation, or the rate of ram/die rotation. Preventing dissimilar metal segregation also produces liners having more consistent, and predictable, operating results. Further, the operating performance of the shaped charges can be tailored by altering coated layers on the powdered heavy metal particles to meet certain desired operating requirements. The operating requirements possibly being a shaped charge designed to produce a specific entrance hole diameter and or specific penetration depth. The coated layers on the powdered heavy metal particles can be comprised of a single binder material, or a combination of two or more binder materials. It is appreciated that the above mentioned operating requirements can be achieved by one skilled in the art without undue experimentation.

The liner 5 of the present invention consists of a range of from 60 percent by weight to 97 percent by weight of powdered heavy metal particles and a range of from 40 percent by weight to 3 percent by weight of a metal binder coating. Although, tungsten is the preferred powdered heavy metal material, other suitable heavy metals such as uranium, tantalum, or molybdenum, to name a few, can be used. Optionally, a lubricant such as oil or graphite can be added during the forming process. Graphite powder can be added at an amount up to 2.0 percent by weight of the liner. The graphite powder acts as a lubricant during the forming process, as is understood by those skilled in the art.

The metal binder coating can be comprised of any highly ductile or malleable metal, possible candidates are selected from the group consisting of copper, lead, nickel, silver, zinc, tin, antimony, gold, tantalum, palladium, other malleable metals, and alloy combinations thereof. However, the preferred metal binder coatings are copper, lead, tantalum, and nickel.

The liner 5 can be retained in the housing 1 by application of adhesive, shown at 6. The adhesive 6 enables the shaped charge 10 to withstand the shock and vibration typically encountered during handling and transportation without movement of the liner 5 or the explosive 2 within the housing 1. It is to be understood that the adhesive 6 is only used for retaining the liner 5 in position within the housing 1 and is not to be construed as a limitation on the invention.

Figure 2A:
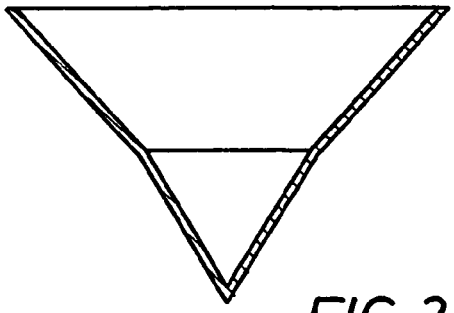
FIG. 2*a* depicts a cross-sectional view of a bi-conical shaped liner.
Figure 2B:
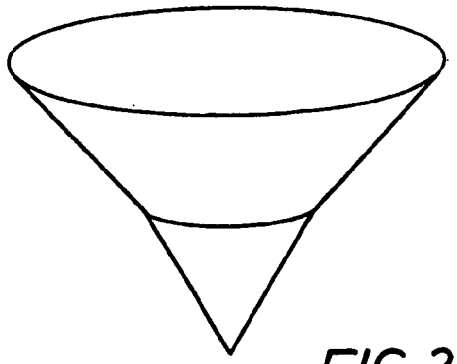
FIG. 2*b* depicts a perspective view of a bi-conical shaped liner.

FIGS. 2*a*–7 provide depictions of additional shaped charge liners. FIGS. 2*a* and 2*b* illustrate in cross-sectional and perspective view a bi-sectional liner. A bi-sectional liner, as is known in the art, is generally conical except that the angle at which the opposing sides diverge increases at a specified distance from the liner apex. FIG. 3 depicts a tulip shaped liner, which as its name suggest mimics the shape of a tulip, i.e. proximate to the liner opening the liner sides curve outward providing a liner opening that is larger than the opening would be if the liner sides did not curve but instead were straight. The hemispherical liner depicted in FIG. 4 is configured to have a circular outer radius. FIG. 5 illustrates a circumferential liner, which is generally frusto-conical and has a rounded apex. The linear liner of FIG. 6, also well known in the art, has a V-shaped cross section with straight sides. The length of the linear liner varies depending on the specific application. The trumpet liner of FIG. 7 is generally conically shaped with sides that curve outward as they travel from the liner apex to the liner opening.

The present invention described herein, therefore, is well adapted to carry out the objects and attain the ends and advantages mentioned, as well as others inherent therein. While a presently preferred embodiment of the invention has been given for purposes of disclosure, numerous changes in the details of procedures for accomplishing the desired results. For example, binders made from bismuth, aluminum, tellurium alloys, and beryllium alloys can be implemented. These and other similar modifications will readily suggest themselves to those skilled in the art, and are intended to be encompassed within the spirit of the present invention disclosed herein and the scope of the appended claims.

What is claimed is:

1. A liner for a shaped charge, which liner comprises: a quantity of powdered heavy metal particles substantially uniformly coated with a metal binder coating and compressively formed into a liner body by cold working, where said liner is collapsible into a penetrating jet upon application of a force to said liner outer surface, where the powdered heavy metal particles comprise an amount greater than 60% by weight to approximately 90% by weight of said liner, and the metal binder comprises from approximately 10% to less than 40% by weight of said liner.

2. The liner for a shaped charge of claim 1 wherein said metal binder coating is selected from the group consisting of copper, lead, nickel, tantalum, other malleable metals, and alloy combinations thereof.

3. The liner for a shaped charge of claim 1, wherein said powdered heavy metal particles are selected from the group consisting of tungsten, uranium, tantalum, and molybdenum.

4. A shaped charge comprising:

a housing;

a quantity of explosive inserted into said housing; and a liner inserted into said housing so that said quantity of explosive is positioned between said liner and said housing, said liner comprising powdered heavy metal particles coated with a metal binder coating and compressively formed into a liner body by cold working, where the powdered heavy metal particles comprise an amount greater than 60% to approximately 90% by weight of said liner and the metal binder comprises from approximately 10% to less than 40% by weight of said liner, and wherein upon detonation of said explosive said liner collapses and is formed into a jet that is ejected from the housing at a very high velocity.

5. The liner for a shaped charge of claim 4 wherein said metal binder coating is selected from the group consisting of copper, lead, nickel, tantalum, other malleable metals, and alloy combinations thereof.

6. The shaped charge of claim 4 wherein said powdered heavy metal particles are selected from the group consisting of tungsten, uranium, tantalum, and molybdenum.

7. A method of forming a shaped charge liner comprising the steps of: coating a multiplicity of powdered heavy metal particles with a metal binder; compressively forming said multiplicity of now coated heavy metal particles into a liner body by cold working, where said liner is collapsible into a penetrating jet upon application of a force to said liner outer surface, where the powdered heavy metal particles comprise an amount greater than 60% to approximately 90% by weight of said liner and the metal binder comprises from approximately 10% to less than 40% by weight of said liner.

8. The method of claim 7 wherein said metal binder coating is selected from the group consisting of copper, lead, nickel, tantalum, other malleable metals, and alloy combinations thereof.

9. The method of claim 7 wherein said powdered heavy metal particles are selected from the group consisting of tungsten, uranium, tantalum, and molybdenum.

* * * * *